US009330573B2

(12) United States Patent
Brandao et al.

(10) Patent No.: US 9,330,573 B2
(45) Date of Patent: May 3, 2016

(54) AUTOMATED DECISION AID TOOL FOR PROMPTING A PILOT TO REQUEST A FLIGHT LEVEL CHANGE

(75) Inventors: Ruy C. Brandao, Redmond, WA (US); Rosa Maria Nicole Weber, Surrey (CA); Willard R. True, Kirkland, WA (US); Michael L. Olive, Cockeysville, MD (US); Christine Marie Haissig, Chanhassen, MN (US)

(73) Assignee: HONEYWELL INTERNATIONAL INC., Morris Plains, NJ (US)

( * ) Notice: Subject to any disclaimer, the term of this patent is extended or adjusted under 35 U.S.C. 154(b) by 1441 days.

(21) Appl. No.: 12/563,691

(22) Filed: Sep. 21, 2009

(65) Prior Publication Data

US 2010/0332054 A1 Dec. 30, 2010

Related U.S. Application Data

(60) Provisional application No. 61/220,470, filed on Jun. 25, 2009.

(51) Int. Cl.
*G08G 5/00* (2006.01)

(52) U.S. Cl.
CPC ..... *G08G 5/0013* (2013.01); *G08G 5/0021* (2013.01); *G08G 5/0039* (2013.01)

(58) Field of Classification Search
CPC .. G08G 5/0013; G08G 5/0021; G08G 5/0039
USPC ..... 701/3, 4, 5, 8, 9, 10, 14, 204
See application file for complete search history.

(56) References Cited

U.S. PATENT DOCUMENTS

| | | | | |
|---|---|---|---|---|
| 3,875,379 | A | 4/1975 | Vietor | |
| 5,077,673 | A | 12/1991 | Brodegard et al. | |
| 5,574,647 | A | 11/1996 | Liden | |
| 5,957,412 | A | 9/1999 | Saint Upery et al. | |
| 6,085,145 | A * | 7/2000 | Taka et al. | 701/120 |
| 6,127,944 | A | 10/2000 | Daly et al. | |
| 6,148,259 | A | 11/2000 | Hagelauer | |
| 6,433,729 | B1 | 8/2002 | Staggs | |

(Continued)

FOREIGN PATENT DOCUMENTS

| | | | |
|---|---|---|---|
| CN | 102254452 | A | 11/2011 |
| EP | 1752739 | A2 | 2/2007 |

(Continued)

OTHER PUBLICATIONS

RTCA, Inc.; Safety, Performance and Interoperability Requirements Document for the In-Trail Procedure in Oceanic Airspace (ATSA-ITP) Application; RTCA/DO-312, Jun. 19, 2008.

(Continued)

*Primary Examiner* — John Q Nguyen
*Assistant Examiner* — Michael Whalen
(74) *Attorney, Agent, or Firm* — Ingrassia Fisher & Lorenz, P.C.

(57) ABSTRACT

Provided are methods and systems for the automatic calculation and presentation of data on a display device alerting a pilot that a change in flight plan is desirable, possible and administratively compliant under air traffic control protocol. The methods and systems may automatically request the flight clearance over a data link or the pilot may override the data link.

20 Claims, 7 Drawing Sheets

(56) References Cited

U.S. PATENT DOCUMENTS

| | | | | |
|---|---|---|---|---|
| 6,469,660 | B1 | 10/2002 | Horvath et al. | |
| 6,690,298 | B1 | 2/2004 | Barber et al. | |
| 6,696,980 | B1 * | 2/2004 | Langner et al. | 340/971 |
| 6,711,479 | B1 | 3/2004 | Staggs | |
| 6,720,891 | B2 | 4/2004 | Chen et al. | |
| 6,799,114 | B2 | 9/2004 | Etnyre | |
| 6,816,780 | B2 | 11/2004 | Naimer et al. | |
| 6,828,921 | B2 | 12/2004 | Brown et al. | |
| 6,839,018 | B2 | 1/2005 | Szeto et al. | |
| 6,876,906 | B1 | 4/2005 | Zellers et al. | |
| 6,946,976 | B1 * | 9/2005 | Langner et al. | 340/971 |
| 6,963,291 | B2 | 11/2005 | Holforty et al. | |
| 7,103,455 | B2 | 9/2006 | Subelet | |
| 7,148,816 | B1 | 12/2006 | Carrico | |
| 7,366,591 | B2 | 4/2008 | Hartmann et al. | |
| 7,367,526 | B2 | 5/2008 | Baudry | |
| 7,375,678 | B2 | 5/2008 | Feyereisen et al. | |
| 7,386,373 | B1 | 6/2008 | Chen et al. | |
| 7,403,843 | B2 | 7/2008 | Gremmert | |
| 7,453,375 | B2 | 11/2008 | Chamas et al. | |
| 7,471,995 | B1 | 12/2008 | Robinson | |
| 7,570,178 | B1 | 8/2009 | Whalen et al. | |
| 7,650,232 | B1 | 1/2010 | Paielli | |
| 7,746,343 | B1 | 6/2010 | Charaniya et al. | |
| 7,747,382 | B2 | 6/2010 | Small et al. | |
| 7,877,197 | B2 | 1/2011 | Lewis et al. | |
| 7,961,135 | B2 | 6/2011 | Smith et al. | |
| 7,965,223 | B1 | 6/2011 | McCusker | |
| 8,271,152 | B2 | 9/2012 | Singer et al. | |
| 8,417,397 | B2 | 4/2013 | Khatwa et al. | |
| 8,478,513 | B1 | 7/2013 | Kar et al. | |
| 8,554,394 | B2 | 10/2013 | Shamasundar | |
| 8,781,649 | B2 | 7/2014 | Kar et al. | |
| 2002/0075171 | A1 | 6/2002 | Kuntman et al. | |
| 2002/0089432 | A1 | 7/2002 | Staggs et al. | |
| 2002/0133294 | A1 | 9/2002 | Farmakis et al. | |
| 2003/0016158 | A1 | 1/2003 | Stayton et al. | |
| 2006/0290562 | A1 | 12/2006 | Ehresman | |
| 2008/0065312 | A1 | 3/2008 | Coulmeau et al. | |
| 2008/0120032 | A1 | 5/2008 | Brandao et al. | |
| 2008/0167885 | A1 | 7/2008 | Judd et al. | |
| 2008/0266054 | A1 | 10/2008 | Crank | |
| 2008/0288164 | A1 | 11/2008 | Lewis et al. | |
| 2008/0309518 | A1 | 12/2008 | Aung | |
| 2009/0024311 | A1 | 1/2009 | Hess | |
| 2009/0088972 | A1 | 4/2009 | Bushnell | |
| 2009/0231163 | A1 | 9/2009 | He | |
| 2009/0267800 | A1 | 10/2009 | Hammack et al. | |
| 2010/0023187 | A1 | 1/2010 | Gannon et al. | |
| 2010/0070180 | A1 | 3/2010 | Ridenour | |
| 2010/0131121 | A1 | 5/2010 | Gerlock | |
| 2010/0152932 | A1 | 6/2010 | Das | |
| 2010/0286900 | A1 | 11/2010 | Depape et al. | |
| 2010/0292871 | A1 | 11/2010 | Schultz et al. | |
| 2010/0305783 | A1 | 12/2010 | Tucker et al. | |
| 2011/0006918 | A1 | 1/2011 | Shafaat et al. | |
| 2011/0066360 | A1 | 3/2011 | Haissig | |
| 2011/0066362 | A1 | 3/2011 | He | |
| 2011/0118981 | A1 | 5/2011 | Chamlou | |
| 2011/0144833 | A1 | 6/2011 | Tjorhom et al. | |
| 2011/0187588 | A1 | 8/2011 | Khatwa et al. | |
| 2011/0224847 | A1 | 9/2011 | Singer et al. | |
| 2011/0231096 | A1 | 9/2011 | Ridenour, II | |
| 2011/0270472 | A1 | 11/2011 | Shafaat et al. | |
| 2011/0270473 | A1 | 11/2011 | Reynolds et al. | |
| 2011/0276198 | A1 | 11/2011 | Khatwa et al. | |
| 2011/0282568 | A1 | 11/2011 | Khatwa et al. | |
| 2011/0316857 | A1 | 12/2011 | Pepitone et al. | |
| 2012/0095623 | A1 | 4/2012 | Barral et al. | |
| 2012/0203448 | A1 | 8/2012 | Pepitone et al. | |
| 2013/0006511 | A1 | 1/2013 | Ramaiah et al. | |

FOREIGN PATENT DOCUMENTS

| | | | |
|---|---|---|---|
| EP | 1752739 | A3 | 1/2008 |
| EP | 1947624 | A1 | 7/2008 |
| EP | 1995706 | A2 | 11/2008 |
| EP | 2071542 | A2 | 6/2009 |
| EP | 2267682 | A2 | 12/2010 |
| EP | 2345872 | A2 | 7/2011 |
| EP | 2388759 | A2 | 11/2011 |
| FR | 2898675 | A1 | 3/2006 |
| FR | 2910124 | A1 | 12/2006 |

OTHER PUBLICATIONS

EP Search Report, EP 10166821.8-1232/2267683 dated Apr. 21, 2011.

EP Communication, EP 10166821.8-1232 dated May 23, 2011.

EP Examination Report for Application No. 10166821.8 dated Jun. 18, 2015.

Koeners, J.; deVries, M.; Delft University of Technology, Delft, The Netherlands; Conflict Resolution Support For Air Traffic Control Based on Solution Spaces: Design and Implementation; 2008 IEEE.

USPTO Notice of Allowance dated Mar. 13, 2013 for U.S. Appl. No. 13/354,777.

USPTO Supplemental Notice of Allowance dated May 28, 2013 for U.S. Appl. No. 13/354,777.

EP Search Report for Application No. EP 13 150 717.0 dated Dec. 3, 2013.

Haissig C. M. et al. "Using TCAS Surveillance to Enable Legacy ADS-B Transponder Use for In-trail Procedures"Digital Avionics Systems Conference (DASC), IEEE/AIAA 31st; published by IEEE on Oct. 14, 2012; pp. 5D5-1.

"Getting to Grips with Surveillance"—Airbus; retrieved from the Internet on Nov. 20, 2013, Url: URL:http://www.cockpitseeker.com/wp-content/uploads/A320/pdf/data/gettingToGripsSurveillancelssue1.pdf.

Chartrand, R.C. et al.; Operational Improvements From Using the In-Trail Procedure in the North Atlantic Organized Track System; NASA/TM-2009-215939, Oct. 2009.

RTCA, Inc.; Safety, Performance and Interoperability Requirements Document for the In-Trail Procedure in Oceanic Airspace (ATSA-ITP) Application; Jun. 19, 2008.

USPTO Office Action for 12/774,513; Notification date May 2, 2012.

USPTO Final Office Action for 12/774,513; notification date Aug. 30, 2012.

USPTO Notice of Allowance for 12/774,513; notification date Dec. 11, 2012.

Chartrand, R. C. et al.; Operational Improvements From Using the In-Trail Procedure in the North Atlantic Organized Track System, Oct. 2009.

Murdoch, J. L. et al.; Enhanced Oceanic Operations Human-In-The-Loop In-Trail Procedure Validation Simulation Study, NASA/TP-2008-215313, Jun. 2008.

Jones, K.M.; ADS-B In-Trail Procedures, Overview of Research Results; National Aeronautics and Space Administration; Presented to the ASAS TN2 Workshop, Sep. 2007.

Alam, S, et al.; An Assessment of BADA Fuel Flow Methodologies for In-Trail Procedure Evaluation; Defence & Security Applications Research Centre, University of New South Wales, Australian Defence Force Academy, Canberra, Australia.

Munoz, C.A. et al.; In-Trail Procedure (ITP) Algorithm Design; National Institute of Aerospace; Hampton, VA.

Richards, W.R. et al.; New Air Traffic Surveillance Technology; www.boeing.com/commercial/aeromagazine.

EP Search Report, EP11 154 857.4, dated Nov. 4, 2012.

EP Examination Report for EP 11 154 857.4, dated May 22, 2012.

Examination Report for EP 11 154 857.4, dated Aug. 30, 2013.

Federal Aviation Administration; NextGen Operator and Airport Enablers; Supplement to NextGen Investment for Operators and Airports, FAA's NextGen Implementation Plan, Mar. 2011.

USPTO Office Action for Application No. 12/721,146; Notification Date Jan. 9, 2012.

USPTO Notice of Allowance for 12/721,146; notification date Jun. 7, 2012.

(56) References Cited

OTHER PUBLICATIONS

EP Search Report dated May 6, 2013 for application no. EP 11 154 900.2.
USPTO Office Action for Application No. 13/424,032 dated Feb. 7, 2014.
EP Search Report for Application No. 13 157 907.0 dated Feb. 4, 2014.
EP Examination Report for Application No. 13 157 907.0 dated Feb. 13, 2014.
USPTO Notice of Allowance for Application No. 13/424,032 dated Mar. 10, 2014.
USPTO Office Action for 13/407,475; notification date Nov. 21, 2012.
USPTO Final Office Action for 13/407,475; notification date Feb. 6, 2013.
USPTO Notice of Allowance for 13/407,475; notification date Jun. 10, 2013.
EP Search Report for Application No. 13 155 828.0 dated Nov. 19, 2013.
CN Office Action & Search Report for Application No. CN 201310123259.0 Dated Nov. 27, 2015.

* cited by examiner

AUTOMATED DECISION AID TOOL FOR PROMPTING A PILOT TO REQUEST A FLIGHT LEVEL CHANGE

PRIORITY CLAIM

This application claims the benefit of U.S. Provisional Application No. 61/220,470 which was filed on Jun. 25, 2009 under 35 U.S.C. §119.

TECHNICAL FIELD

The subject matter described herein relates to the automatic generation and transmission of a clearance message to an air traffic control ("ATC") authority requesting a flight level change based on an automatically determined desirability for and possibility of completing the flight level change.

BACKGROUND

In flight, a pilot navigates their aircraft according to a flight plan that is filed with the ATC authorities. The flight plan may be manually or electronically loaded into the aircraft's Flight Management System ("FMS") at the beginning of the flight, prior to departure. Among other things, the flight plan typically includes a plurality of geographic waypoints that define a planned track of the aircraft and the specific times at which the aircraft is to arrive at those waypoints. The flight plan may also require that ascent maneuvers, descent maneuvers and turn maneuvers be conducted at some of those waypoints. The flight plan, when associated with aircraft performance information and metereological conditions from aircraft sensors (e.g. fuel burn rates), are used by the FMS or other avionics system (e.g. an electronic flight bag ("EFB")) to determine important flight performance metrics such as, for example, fuel consumption, environmental impact, estimated times of arrival ("ETA"), and flight overhead costs.

Normally, clearance changes in a flight plan are communicated to an aircraft in flight and may be displayed in the aircraft's Cockpit Display Unit ("CDU"). Exemplary, non-limiting types of a CDU include a Data-link Cockpit Display Unit ("DCDU") and a Multi-Purpose Cockpit Display Unit. ("MCDU"). Typically, the flight crew reviews the clearance and evaluates the change in the flight plan to determine the impact of the clearance on the aircraft's fuel supply, its ETA and other flight parameters (e.g. speed of advance, crew costs and overhead costs). The pilot then either signals the acceptance of the clearance with a positive or a "Wilco" response, or signals the rejection of the clearance with an "Unable" response. These responses are usually accomplished by manipulating a physical transducer, such as a button or a switch, which is located proximate to an electronically rendered selection label on the CDU or MCDU.

However, in transoceanic flight positive ATC is not effective or even possible because the ATC radar does not reach the aircraft. As such, aircraft traverse oceanic airspace by following certain aircraft separation procedures. The separation procedures limit the ability to make altitude changes even if it desirable and can easily be done. To overcome the limitations allowing altitude changes, In Trail Procedures ("ITP") have been developed to facilitate desirable altitude changes while preventing close encounters with other aircraft. The ITP are more fully described in RTCA DO-312 entitled "Safety, Performance and Interoperability Requirements Document for the In-Trail Procedure in Oceanic Airspace (ATSA-ITP) Application", *RTCA Incorporated*, Washington D.C. (2008) and is herein incorporated by reference its entirety in the interest of brevity. In short, the ITP insures that a minimum distance is maintained from a reference aircraft, while own ship transitions to a new flight level.

During transit, it is a common occurrence for a pilot to want to change altitude for economic, weather or other reasons. However, because of the absence of positive ATC from which to evaluate a change in an aircraft's flight plan during flight, the pilot must personally determine if the flight level change is possible (i.e. likely to be granted by the ATC) under the ITP, and then determine if a flight level change is desirable (e.g. cost and/or time effective). Conventionally, such decisions were made manually from information synthesized from various cockpit information sources.

In order to determine the desirability of changing the flown flight level (i.e. requesting a clearance), a pilot typically runs the original flight plan through the FMS or an EFB to obtain a set of flight parameters based on the original flight plan. The pilot may then key in changes to the flight plan related to the desired flight level. The pilot may process the amended flight plan back through the FMS to obtain a pro form a set of flight parameters. The pilot then manually compares both sets of flight parameters to determine the acceptability of any resulting changes in ETA, changes in fuel consumption, environmental impact, flight overhead costs, etc. The pilot then must manually determine whether the ITP procedures would permit him to make the clearance change. Such procedures may result in significant heads down time during which the pilot's attention may be diverted. Therefore, there is a need to improve the clearance decision process to minimize administrative work load, eliminate heads down time and also not inadvertently miss an opportunity to perform a desirable flight level change.

BRIEF SUMMARY

It should be appreciated that this Summary is provided to introduce a selection of non-limiting concepts. The embodiments disclosed herein are exemplary as the combinations and permutations of various features of the subject matter disclosed herein are voluminous. The discussion herein is limited for the sake of clarity and brevity.

A method is provided for automatically requesting a flight clearance by a computing device. The method includes receiving data from a processor aboard a first aircraft indicating that a flight plan change is both desirable and physically possible, and determining that the flight plan change complies with an air traffic control policy. If the flight plan change conforms to the air traffic control policy, then automatically sending a Controller Pilot Data Link Communication (CPDLC) message to an air traffic authority.

A method is provided for automatically requesting a flight clearance by a computing device. The method includes receiving data from a processor aboard a first aircraft indicating that a flight plan change is both desirable and physically possible, and determining that the flight plan change complies with an air traffic control policy. If the flight plan change conforms to the air traffic control policy, then alerting a crew member to the opportunity to may the flight plan change.

A system for automatically requesting a flight clearance during a flight is also provided. The system comprises a means for sensing an avionics metric and a means for creating a clearance message requesting a clearance based at least in part upon the sensed avionics metric. The system also includes a means for automatically transmitting the clearance message requesting a clearance when both a flight plan change is determined to be desirable and when the flight plan change complies with an air traffic control (ATC) policy based in part upon the sensing of the avionics metric.

BRIEF DESCRIPTION OF THE DRAWINGS

The present invention will hereinafter be described in conjunction with the following drawing figures, wherein like numerals denote like elements.

DETAILED DESCRIPTION

The following disclosure is directed to systems and methods that automatically provide information to a vehicle operator that describes the impact from one or more changes in the vehicle's flight level on mission critical parameters of their vehicle. Non-limiting, exemplary examples of mission critical parameters may include changes in ETA, changes in fuel consumption, crew costs, engine hours, environmental impact and other flight overhead costs.

The vehicle operator may be an onboard operator in the case of a manned vehicle or aircraft or a remote operator in the case of a remotely controlled vehicle. In the case of a robotic vehicle, there may not be an operator at all.

The methods and systems generate a pre-configured clearance request message if the desired flight level is deemed possible to achieve under the ITP. Means for automatically generating clearance request messages are discussed in further detail in co-pending and co-owned U.S. patent application Ser. No. 11/621,653 which is herein incorporated by reference in its entirety.

The subject matter now will be described more fully below with reference to the attached drawings which are illustrative of various embodiments disclosed herein. Like numbers refer to like objects throughout the following disclosure. The attached drawings have been simplified to clarify the understanding of the systems, devices and methods disclosed. The subject matter may be embodied in a variety of forms. The exemplary configurations and descriptions, infra, are provided to more fully convey the subject matter disclosed herein.

The subject matter herein will be disclosed below in the context of an aircraft. However, it will be understood by those of ordinary skill in the art that the subject matter is similarly applicable to many vehicle types. Non-limiting examples of other vehicle types in which the subject matter herein below may be applied includes manned aircraft, unmanned aircraft, spacecraft, aerial system, watercraft, robotic vehicles and manned terrestrial motor vehicles. The subject matter disclosed herein may be incorporated into any suitable navigation or flight data system that currently exists or that may be developed in the future. Without limitation, terrestrial motor vehicles may also include military combat and support vehicles of any description. As a non-limiting alternative embodiment, the subject matter herein may be used to navigate a ship where the possibility of a course change would be determined by either the inland or international rules of the road. The desirability of such a maneuver may include fuel state, ETA change, and the perishable nature of any cargo.

Figure 1:
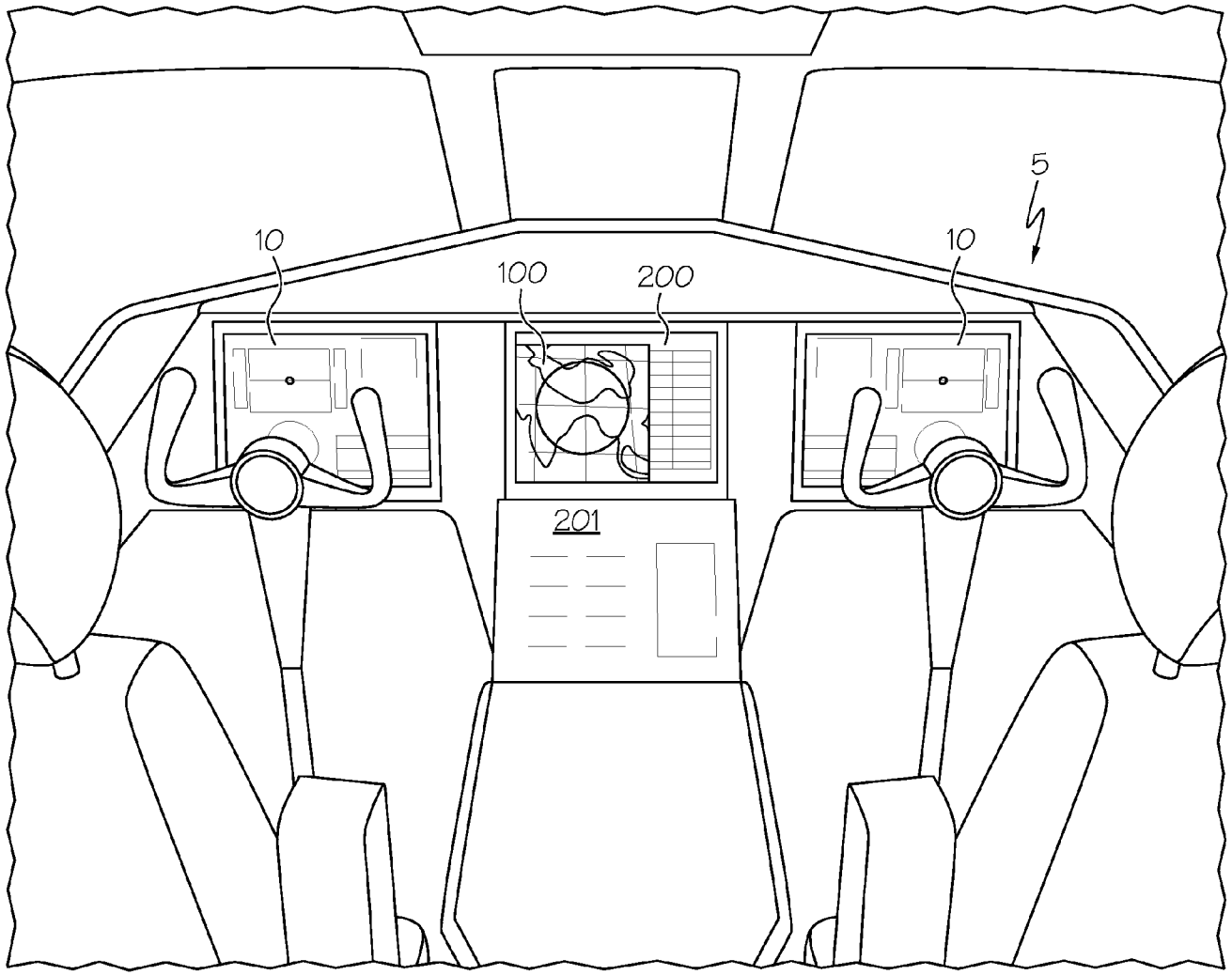
FIG. 1 is a rendition of an aircraft cockpit showing an exemplary location of a Control Display Unit.

FIG. 1 is an exemplary view of a generic aircraft equipped with a Flight Management System (FMS) 5 that may communicate with, or may incorporate within itself, a CDU 200, which may also include one or more electronic display panels 204. (See FIGS. 2A-B). Generally, the FMS 5 may communicate with, or may comprise a primary flight display 10 for each of the pilot and co-pilot, which displays information for controlling the aircraft. The FMS 5 may communicate with, or may also include a navigation display 100, which may also be referred to herein as a "moving map", which may be used in conjunction with the CDU 200. FMS 5 and CDU 200 may be in operable communication with data up-link unit 201, as will be discussed further below. In a non-aircraft embodiment, the FMS 5 may instead be a radar console, a radar repeater or a command display.

An aircraft may also be equipped with a Traffic Collision Avoidance System ("TCAS") or a TCAS and a related traffic computer. The TCAS utilizes onboard radar to locate and track other aircraft and extrapolate that information. In such cases where the TCAS and/or the traffic computer detects a situation with a constant relative bearing and a decreasing range, the TCAS will alert the pilot that an evasive maneuver may be required.

Figure 2A:
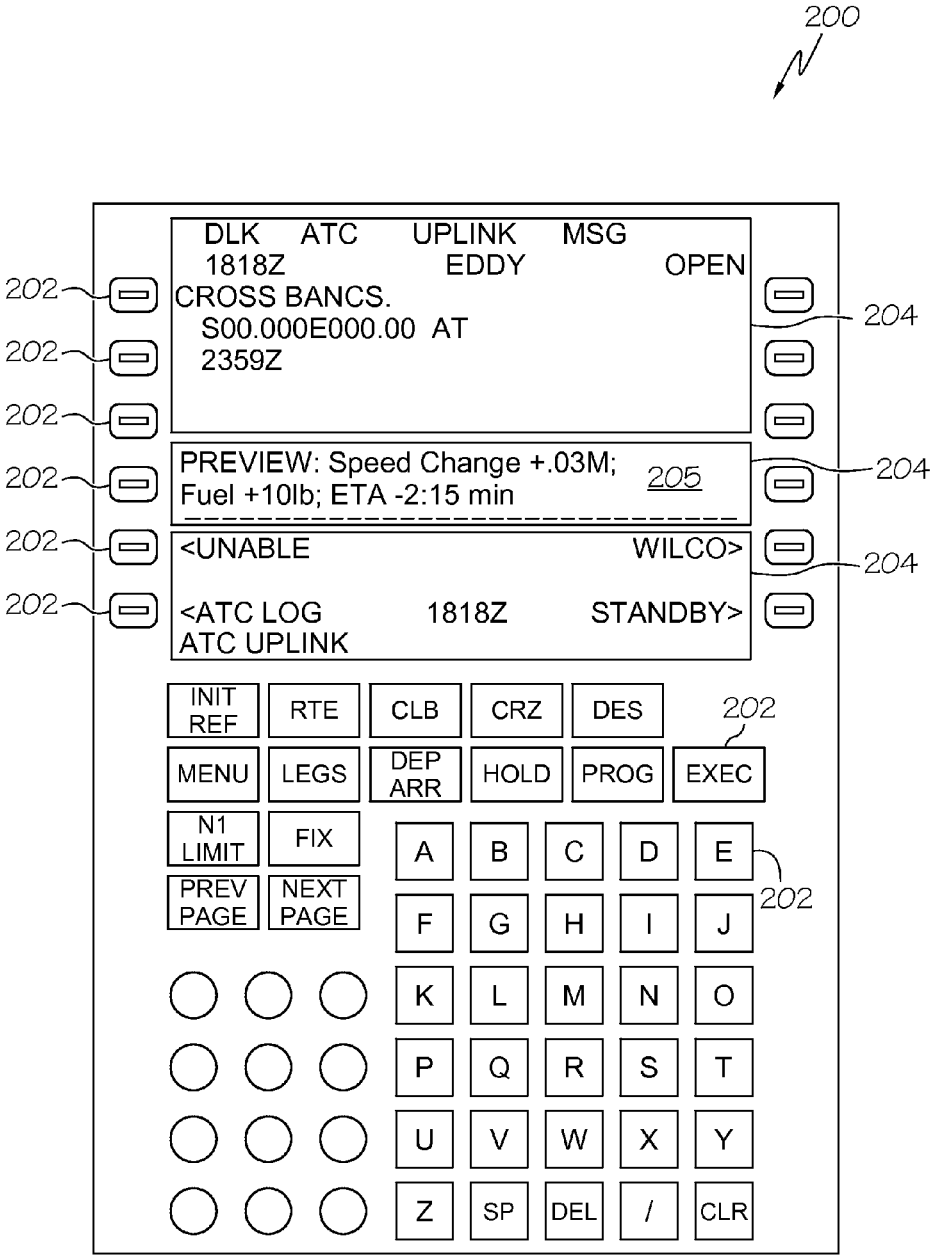
FIG. 2*a* illustrates an exemplary Control Display Unit for a Boeing aircraft.
Figure 2B:
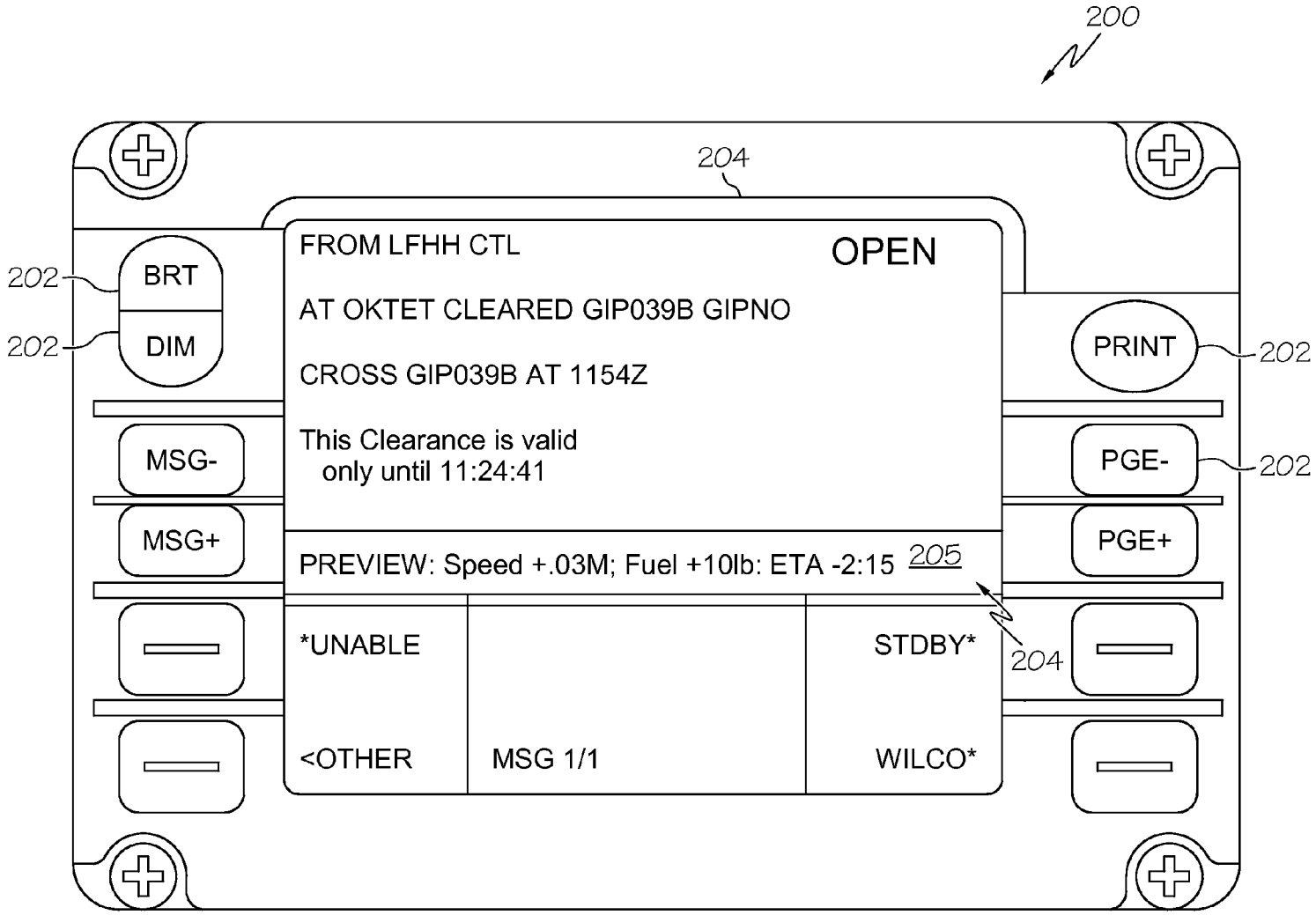
FIG. 2*b* illustrates an exemplary Control Display Unit for an Airbus aircraft.

FIGS. 2*a* and 2*b* are independent renditions of non-limiting exemplary CDUs 200. In one embodiment, CDU 200 may comprise a physical display device with multiple physical input transducers 202 and multiple physical display panels 204 for interfacing with the flight crew. Exemplary, non-limiting transducers 202 may include push buttons, switches, knobs, touch pads and the like. Exemplary, non-limiting display panels 204 may include light emitting diode arrays, liquid crystal displays, cathode ray tubes, incandescent lamps, etc.

In another embodiment, the CDU 200 may be a virtual device. The display for the virtual device may be rendered on a general purpose electronic display device where the input transducers 202 and display panels 204 are electronic, graphical renditions of a physical device. Such electronic display devices may be any type of display device known in the art. Non-limiting examples of a display device may be a cathode ray tube, a liquid crystal display and a plasma screen. However, any suitable display device developed now or in the future is contemplated to be within the scope of this disclosure. Regardless of the nature of the CDU 200, the desirability of a flight level change may be displayed in a display panel 204, such as the information 205 of FIGS. 2A and 2B.

Figure 3:
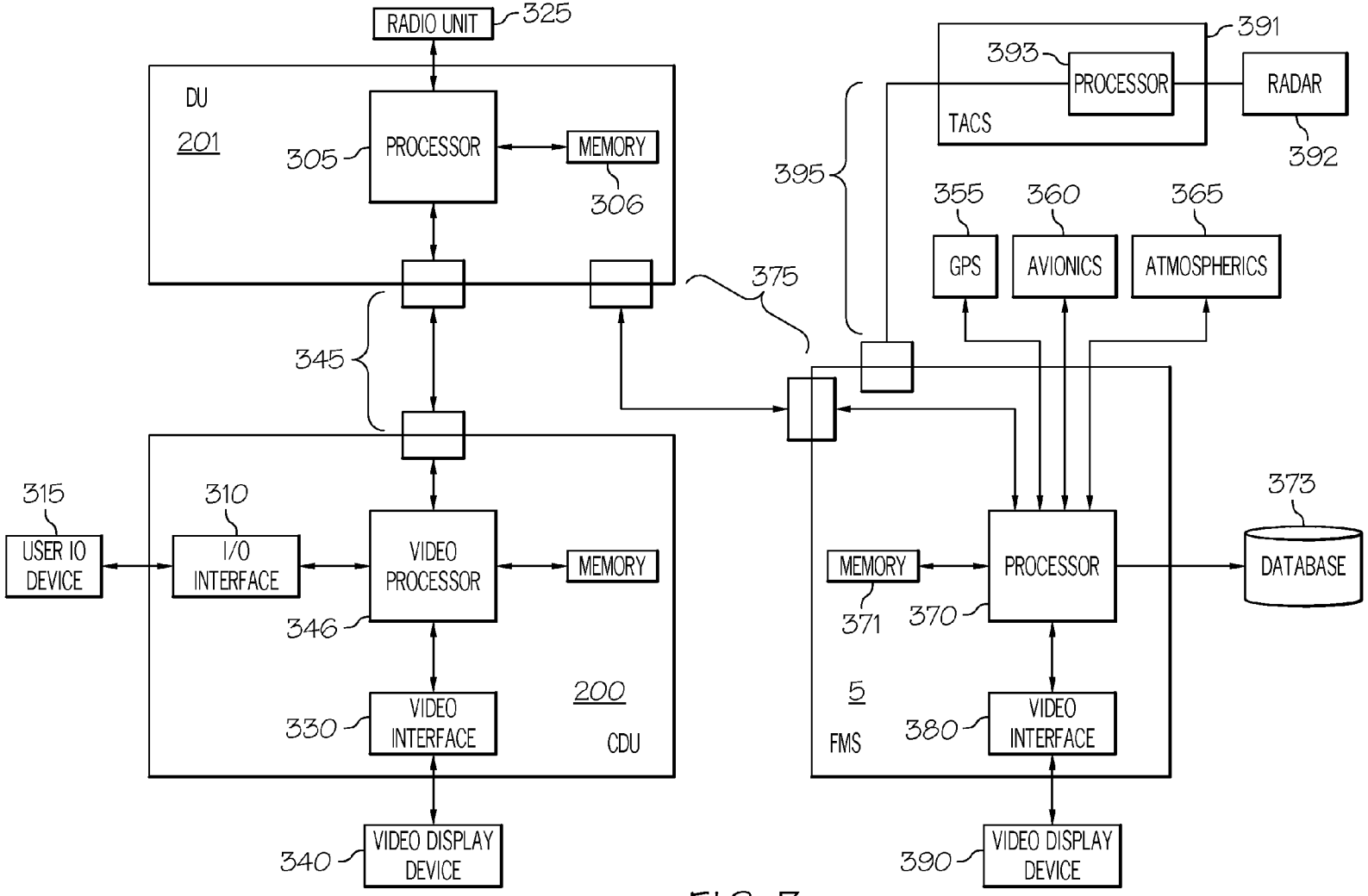
FIG. 3 illustrates a simplified, non-limiting system for implementing the subject matter describes herein.

FIG. 3, depicts an exemplary system 300 that may be used to implement the subject matter described herein. Although this exemplary embodiment discloses an FMS 5, a data up-link unit 201, a TCAS 391 and a CDU 200 as separate units, it would be readily apparent to one of ordinary skill in the art that the functions of the FMS 5, the data up-link unit 201, TCAS 391 and the CDU 200 may be combined into a single computing device, broken out into additional devices or be distributed over a wireless or a wired network.

FMS 5 may comprise a processor 370. Processor 370 may be any suitable processor or combination of sub-processors that may be known in the art. Processor 370 may include a central processing unit, an embedded processor, a specialized processor (e.g. digital signal processor), or any other electronic element responsible for interpretation and execution of instructions, performance of calculations and/or execution of voice recognition protocols. Processor 370 may communicate with, control and/or work in concert with, other functional components, including but not limited to a video display device 390 via a video interface 380, a geographical positioning system ("GPS") 355, a database 373, one or more avionic sensor/processors 360, one or more atmospheric sensor processors 365, and/or one or more data interfaces 375. The processor 370 is a non-limiting example of a computer readable medium.

The processor 370, as noted above, may communicate with database 373. Database 373 may be any suitable type of database known in the art. Non-limiting exemplary types of databases include flat databases, relational databases, and post-relational databases that may currently exist or be developed in the future. Database 373 may be recorded on any suitable type of non-volatile or volatile memory devices such as an optical disk, programmable logic devices, read only memory, random access memory, flash memory and magnetic disks. The database 373 may store flight plan data, aircraft operating data, navigation data and other data as may be operationally useful. The database 373 may be an additional, non-limiting example of a computer readable medium.

Processor 370 may include or communicate with a memory module 371. Memory module 371 may comprise any type or combination of Read Only Memory, Random Access Memory, flash memory, programmable logic devices (e.g. a programmable gate array) and/or any other suitable memory device that may currently exist or be developed in the future. The memory module 371 is a non-limiting example of a computer readable medium and may store any suitable type of information. Non-limiting, example of such information include flight plan data, flight plan change data, aircraft operating data and navigation data.

The data I/O interface 375 may be any suitable type of wired or wireless interface as may be known in the art. The data I/O interface 375 receives parsed data clearance message information from data up-link unit 201 and forwards the parsed data to the processor 370. The I/O interface 375 also receives parameter differential data from the processor 370 and translates the parameter differential data for use by processor 305, and vice versa. Wireless interfaces, if used to implement the data I/O interface may operate using any suitable wireless protocol. Non-limiting, exemplary wireless protocols may include Wi-Fi, Bluetooth, and Zigbee.

The TCAS 391 may comprise a processor 393. Processor 393 may be any suitable processor or combination of sub-processors that may be known in the art. Processor 370 may include a central processing unit, an embedded processor, a specialized processor (e.g. digital signal processor), or any other electronic element responsible for interpretation and execution of instructions, performance of calculations and/or execution of voice recognition protocols. Processor 393 may communicate with, control and/or work in concert with, other functional components, including but not limited to an avionics sensors/processors 360, radar module 392 and FMS 5 via interface 395. The processor 393 is a non-limiting example of a computer readable medium.

TCAS 391 is an aircraft collision avoidance system designed to reduce the incidence of mid-air collisions between aircraft utilizing target identification systems. It monitors the airspace around an aircraft for other aircraft equipped with a corresponding active transponder and warns pilots of the presence of other transponder-equipped aircraft which may upon a rare occasion present a threat of mid-air collision. TCAS is a secondary surveillance radar ("SSR") transponder that the aircraft operates independently of ground-based equipment. The TCAS provides advice to the pilot on potential conflicting aircraft that are also equipped with SSR transponders. Some non-limiting exemplary target identification systems may include radar, beacon transponders and an Automatic Dependent Surveillance-Broadcast (ADS-B) system. Some versions of TCAS 391 may include ADS-B receiver capability.

Through constant back-and-forth communication between SSR transponders of nearby aircraft, the TCAS 391 builds a three dimensional map of other aircraft in the airspace and incorporates their bearing, altitude and range. Then, by extrapolating current range and altitude difference to anticipated future values, it determines if a potential collision threat exists or does not exist. Similarly, data from the TCAS 391 (or from the TCAS with ADS-B receive capability) may be used to determine if a flight level change would cause the maneuvering aircraft to violate ITP distance or relative ground speed limitations. In other words the TCAS 391 informs the pilot if a flight level change is procedurally possible given the local traffic.

The data up-link ("DU") unit 201 includes processor 305. Processor 305 may be any suitable processor or combination of sub-processors that may be known in the art. Processor 305 may include a central processing unit, an embedded processor, a specialized processor (e.g. digital signal processor), or any other electronic element responsible for the interpretation and execution of instructions, the performance of calculations and/or the execution of voice recognition protocols. Processor 305 may communicate with, control and/or work in concert with, other functional components including but not limited to a video display device 340 via a video processor 346 and a video interface 330, a user I/O device 315 via an I/O interface 310, one or more data interfaces 345/375/395 and/or a radio unit 325. The processor 305 is a non-limiting example of a computer readable medium. I/O device 315 and video display device 340 may be components within CDU 200 and also may include the above mentioned transducers 202 and the visual display panels 204. It will be appreciated that the DU 201 and the CDU 200 may be combined into one integrated device.

Processor 305 may include or communicate with a memory module 306. Memory module 306 may comprise any type or combination of Read Only Memory, Random Access Memory, flash memory, programmable logic devices (e.g. a field programmable gate array) and/or any other suitable memory device that may currently exist or be developed in the future. The memory module 306 is a non-limiting example of a computer readable medium and may contain any suitably configured data. Such exemplary, non-limiting data may include flight plan data, clearance message data, and flight parameter differential data.

The data I/O interface 345 may be any suitable type of wired or wireless interface as may be known in the art. The data I/O interface 345 receives a parsed data clearance message from processor 305 and translates the parsed data clearance data into a format that may be readable by the video processor 346 of CDU 200 for display in video display device 340. The data I/O interface 345 also receives pilot response information generated by user I/O device 315 via I/O interface 310 for transmission back to the flight control authority via radio unit 325 via processor 305.

Figure 4:
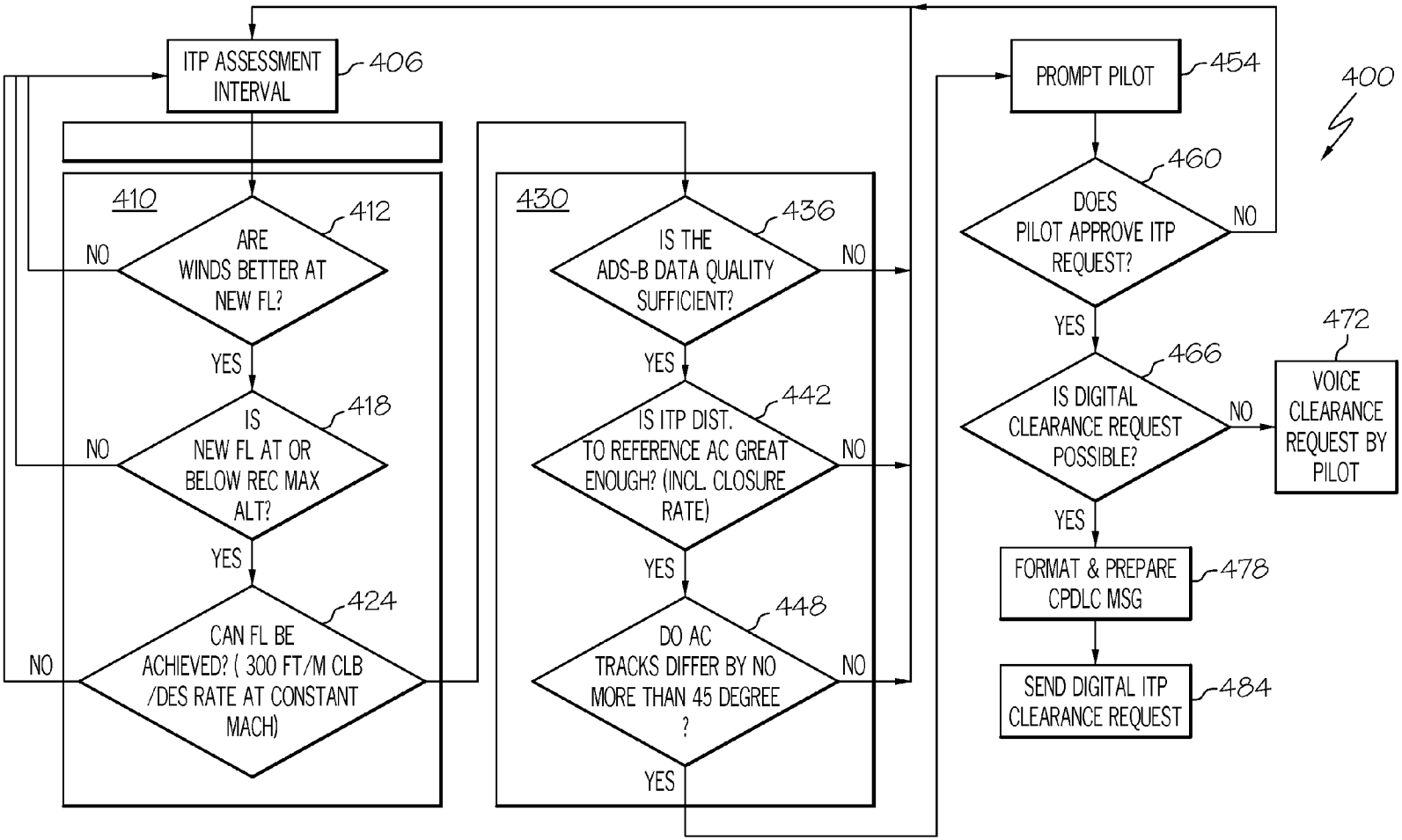
FIG. 4 illustrates an exemplary flow chart incorporating the disclosed subject matter.

FIG. 4 is a simplified flow chart illustrating logic steps for an exemplary, non-limiting method for implementing the subject matter disclosed herein. One of ordinary skill in the art will recognize after reading the disclosure herein, that the processes disclosed in FIG. 4 are not the only processes that may be used to implement the various embodiments of the subject matter disclosed herein. Processes may be separated into their logical sub-processes, functionally equivalent processes may be substituted and processes may be combined. In some embodiments the order of two or more of the processes may be reversed.

In exemplary embodiments, the process for automatically producing a clearance request message may begin at process 406 where an assessment interval has elapsed. The assessment interval, its measurement and its termination may be effectuated using any suitable clock or other timing circuitry known in the art. Non-exemplary timing devices may be a clock or a count down timer.

At process 408, the processor 370 of the FMS 5 may periodically calculate an optimal flight level for the aircraft. The optimal flight level may be based on current data from any or all of the aircraft's on board systems which may include the aircraft avionics 360, atmospheric sensors 365 and GPS 355. Methods for calculating optimum cruising altitude are known in the art. Methods for determining optimum cruising altitudes that are also constrained by air traffic control protocols are also known in the art. For example, co-owned U.S. Pat. No. 5,574,647 describes exemplary apparatuses and methods for determining the legally optimal flight altitudes incorporating prevailing winds and is incorporated herein by reference in its entirety. When the optimal flight level has been determined, the method proceeds to process 410 where it is determined if the new flight level is desirable.

Process 410 may comprise one or more sub-processes. In some embodiments, a determination may be made as to whether the winds are better at the new flight level at sub-process 412. Wind calculations may be determined by any number of on board computing devices including the FMS 5. If better winds do not exist, then the method 400 returns to process 406. Better winds in the context of the subject matter disclosed herein may be defined as true winds that deliver an operating cost advantage. For example, better winds in some embodiments may be defined as true winds that are blowing from direction abaft the aircraft and are additive to forward speed over the ground or better winds may be defined as a relative or a true head wind that has a smaller magnitude. In alternative embodiments, better winds may be defined as winds resulting in better fuel economy or a more advantageous ETA. For example, a military aircraft may need to arrive on station at a specific time. As such, fuel economy may be subordinated as a cost factor in favor of achieving a specific time on top of a target.

At sub-process 418, it is determined if the new flight level is at or below the aircraft's maximum altitude. Maximum altitude may be any stipulated altitude. Exemplary, non-limiting maximum altitudes may be a maximum recommended altitude, a maximum rated altitude, a maximum design altitude or a maximum altitude wherein breathing apparatus is not needed in case of a loss of cabin pressure. If the new flight level is above the stipulated maximum altitude, the method 400 returns to process 406 to await the expiration of the next assessment interval after which process 410 is again conducted.

At sub-process 424, it is determined if the new flight level can be achieved within predefined administrative constraints. Non-limiting examples of these predefined administrative parameters may be a maximum stipulated ascent/descent velocity vector, a maximum rated ascent/descent velocity vector, or an ascent/descent vector that avoids an approach proximate to another aircraft or obstacle. The predefined administration procedures may be contained in an operating protocol, a non-limiting example of which may be the ITP or other air traffic control protocol. Should one of the above sub-processes 412, 418 or 424 result in a negative determination, then the method 400 returns to process 406 to await the expiration of the next assessment interval after which process 410 is again conducted.

If the new flight level is determined to be desirable in that the sub-processes (412, 418, and 424) of process 410 meet the stipulated criteria, then the method 400 proceeds to process 430 where it is determined whether the flight level change can be accomplished without violating ITP procedure. This determination may be made by the FMS or EFB with data from the TCAS system, by the TCAS itself or by another airborne computing system.

At sub-process 436 a determination is made as to whether the electronic data utilized to make the determination at process 430 is of satisfactory quality. At sub-process 436, the quality of information upon which the change in flight level is based is evaluated. The required data quality standards are also defined in RTCA DO-312.

If the quality of information is unsatisfactory, then the method 400 returns to process 406 to await the expiration of the next assessment interval at which process 410 is again conducted. If the quality of information is acceptable, the method 400 proceeds to sub-process 442. Non-limiting exemplary onboard sources of information may include on board TCAS radar, altimeter readings and shore/sea based navigation aids such as radio frequency direction finding signals and ADS-B.

ADS-B is a component of the nation's next-generation air transportation system. Aircraft automatically report aircraft position, velocity, identification data and associated quality data. ADS-B enables radar-like displays with highly accurate traffic data from satellites for both pilots and controllers. ADS-B displays that data in real time which does not degrade with distance or terrain. The system will also give pilots access to weather services, terrain maps and flight information services. The improved traffic surveillance data provided by ADS-B will enable enhanced situational awareness and improved airborne and ground based separation services.

At sub-process 442, the TCAS determines if the distance to the next aircraft ahead (i.e. a "reference aircraft") is great enough under the ITP to allow an altitude maneuver. If so, it is determined whether the track of its aircraft and the track of the reference aircraft differ by no more that 45° at sub-process 448 as required by the ITP.

Should any of sub-processes 436, 442 or 448 be determined not to be satisfied, then the method 400 returns to process 406 to await the expiration of the next assessment interval after which process 410 is again conducted. If all of the processes 436-448 are satisfied, then the method proceeds to process 454.

At process 454, the pilot is alerted or prompted that a flight level change is both desirable and possible under the ITP. Such indication may be accomplished using any suitable indicator. Non-limiting, exemplary indicators may include the energizing or extinguishing of a light, delivery of a text message, and an audio indication such as an alarm or a synthesized voice.

The FMS 5 may generate and/or render the flight level request to the pilot in a suitable format for maneuvering data that is well understood in the art. The maneuvering data may be rendered on a display unit 204 on the CDU 200 or other cockpit computing device as may be found to be useful. If the pilot rejects or ignores the ITP flight level request from the CDU 200 at process 460, then the process may cycle back to process 406 or may proceed to other logic (not shown).

If the pilot approves the ITP flight level request at process 460, it is then determined if a request by digital down link is possible at process 466. Means for determining if a digital down link is possible are well known in the art. Non-limiting examples may include the examination of data link availability status indicated by the data link communications equipment, a test transmission, or a test of reception quality. If a sending a digital clearance message via a down link is not possible then the pilot may verbally transmit the request by HF/VHF/UHF/Satellite voice communication at process 472.

If it is determined as process 466 that it is possible to transmit the flight level request via a digital down link and if the CDU is set to automatic transmission, then the DU 201 may automatically transmit the clearance request message to the responsible ATC authority without further pilot intervention via DU 201.

At process 478, a digital Controller Pilot Data Link Communication ("CPDLC") message is prepared and formatted as is known in the art. A CPDLC is a means of communication between the ATC and the pilot using data link for ATC communication. The CPDLC application provides air-ground data communication for the ATC service. This includes a set of clearance/information/request message elements and formats which correspond to voice phraseology employed by ATC procedures. The ATC controller is provided with the capability to issue level assignments, crossing constraints, lateral deviations, route changes and clearances, speed assignments, radio frequency assignments, and various requests for information. The pilot is provided with the capability to respond to messages, to request clearances and information, to report information, and to declare/rescind an emergency. A "free text" capability is also provided to exchange information not conforming to defined formats.

The sequence of messages between the controller and a pilot relating to a particular transaction (for example request and receipt of a flight level clearance) is termed a 'dialogue'. There can be several sequences of messages in the dialogue, each of which is closed by means of appropriate messages, usually of acknowledgement or acceptance. Closure of the dialogue does not necessarily terminate the link, since there can be several dialogues between controller and pilot while an aircraft transits the controlled airspace.

At process 484 the digital CPDLC request is sent. However, if the DU 201 is not set for automatic transmission, then the pilot may send the clearance message manually via the DU 201 over HF/VHF/UHF/SATCOM voice systems.

Figure 5A:
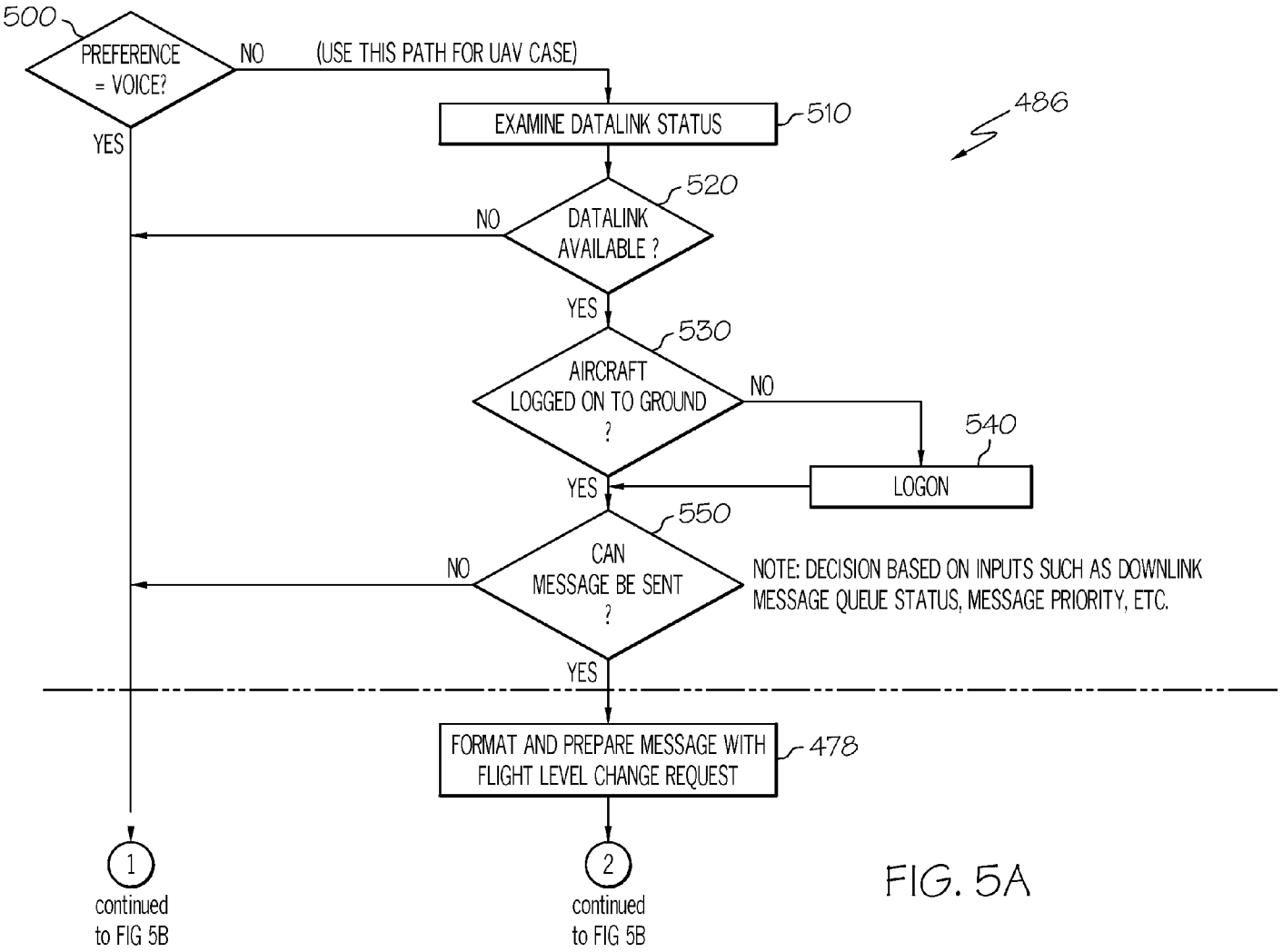
FIGS. 5 A and 5B illustrate an exemplary flow chart breaking out communication sub-processes.
Figure 5B:
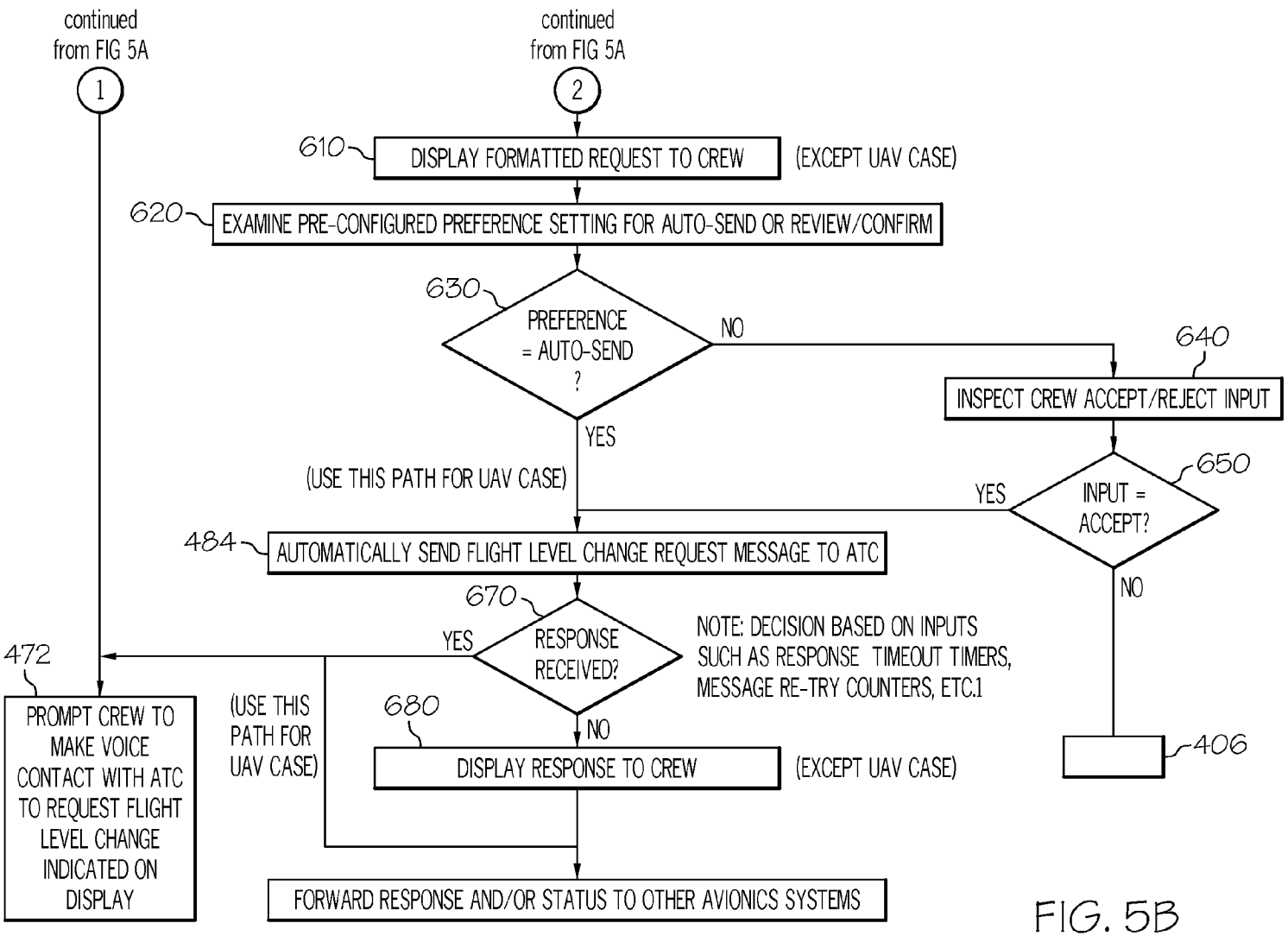

FIG. 5A presents a more detailed flow logic diagram breaking out process 466 into component processes. At process 500, it is determined whether or not the pilot has made a preference choice by indicating to the DU 201 whether or not clearances will be transmitted by voice or by data link over radio unit 325. In some embodiments, the preference may be automated via a configuration database that is pre-configured by the equipment operator. If the pilot has indicated a preference for voice communications then the method 400 proceeds to process 472. If the pilot has indicated a preference that an automatic downlink be used for clearances, the method 400 proceeds to process 510 where the data link status is examined.

At process 520, it is determined if the data link is available. If the data link is not available, then the method 400 proceeds to process 472. If the data link is available then the method 400 proceeds to process 530 where it is determined if the aircraft is logged into a ground based ATC facility. If not, then a logon procedure is performed at process 540. If already logged on, then a determination is made at process 550 as to whether a clearance request message may be sent. Such a determination may be made based on various received inputs including but not limited to a down link message queue status, message priority, etc.

If it is determined that the message cannot be sent then the method 400 proceeds to process 472. If it is determined that the message can be sent then the process proceeds to process 478.

In process 478, the flight level change request message is formatted for transmission via the DU 201, as discussed above, and may be optionally displayed to the pilot for review at process 610. At process 620, a preference setting for either an auto-send mode or for a review-and-confirm mode is determined.

If a determination is made that the auto-send mode is set at process 630, the method advances to process 484. If the determination is made that the auto-send preference is not set then the flight level change request message is presented to the pilot for acceptance or rejection. If accepted at process 650 then the flight level change request message is automatically sent to the ATC authority at process 484. If the message is rejected then the method 400 returns to process 406. One of ordinary skill in that are will appreciate after reading the disclosure herein that in embodiments where an unmanned aircraft or vehicle is concerned, the auto-send mode would be set. As such, processes 640 and 650 would be disabled.

At process 670, a determination is made as to whether or not a response to the flight level change request message is received from the ATC authority. If no response is received then the crew is prompted to make voice contact at process 472. If a response is received, then the response is displayed to the Pilot or a remote pilot at process 680 and is forwarded to the FMS 5 and other avionics systems at process 682. One of ordinary skill in that are will appreciate after reading the disclosure herein that in embodiments where an unmanned aircraft or vehicle is concerned, process 680 may be disabled since that is no crew aboard. However, for embodiments where the vehicle is remotely controlled, the remote pilot may receive the display at process 680.

The subject matter described above is provided by way of illustration only and should not be construed as being limiting. Various modifications and changes may be made to the subject matter described herein without following the example embodiments and applications illustrated and described, and without departing from the true spirit and scope of the present invention, which is set forth in the following claims.

What is claimed is:

1. A method for automatically requesting a flight clearance by an onboard computing device, the method comprising the steps of:

receiving data from a processor aboard a first aircraft indicating that a flight plan change both improves a flight metric and is physically possible;

determining that the flight plan change complies with an air traffic control policy; and when the flight plan change conforms to the air traffic control policy, then automatically sending a Controller Pilot Data Link Communication (CPDLC) flight clearance request message to an air traffic authority.

2. The method of claim 1 wherein the air traffic control policy requires a minimum difference between a first distance from a first aircraft to a reference point and a second distance from a reference aircraft to the reference point must be greater than a predetermined amount before initiating a flight level change.

3. The method of claim 2 wherein the air traffic control policy stipulates that the tracks of the reference aircraft and the first aircraft can differ by no more than 45° relative.

4. The method of claim 1 further comprising alerting a pilot that the flight plan change improves a flight metric, is physically possible and complies with the air traffic control policy.

5. The method of claim 4 further comprising providing the pilot with an option to reject the fight plan change when alerted.

6. The method of claim 1 further comprising determining whether the data indicating that a flight plan change both improves a flight metric and is physically possible is of a minimum quality.

7. The method of claim 1 wherein the data indicating that a flight plan both improves a flight metric and is physically possible includes a determination that the winds on the new flight plan are more favorable.

8. The method of claim 7 wherein the data indicating that a flight plan change both improves a flight metric and is physically possible includes a determination that the flight plan does not exceed a predetermined maximum altitude.

9. A system for automatically requesting a flight clearance during a flight, comprising:

means for sensing an avionics metric;

means for creating a clearance message requesting a clearance based at least in part upon the sensed avionics metric;

means for automatically transmitting the clearance message requesting a clearance when both a flight plan change is determined to improve an avionics metric and when the flight plan change complies with an air traffic control (ATC) policy based in part upon the sensing of the avionics metric.

10. The system of claim 9 further comprising means for analyzing compliance with the ATC policy.

11. The system of claim 10 further comprising means for determining a flight plan change results in an improved avionics metric.

12. The system of claim 11, wherein the ATC policy is an in trail procedure.

13. The system of claim 12, wherein determining that a flight plan change results in an improved avionics metric includes determining if the flight plan change reduces the flight cost.

14. The system of claim 12, wherein determining that a flight plan change results in an improved avionics metric includes determining if the flight plan change results in a required time of arrival.

15. The system of claim 12, wherein determining that a flight plan change results in an improved avionics metric includes determining if the flight plan change maintains a flight level below a stipulate level.

16. The system of claim 12, wherein determining that a flight plan change results in an improved avionics metric includes determining if the flight plan change maintains a stipulated rate of change in altitude.

17. A system for automatically requesting a flight clearance during a flight by a computing device, comprising:

a sensor;

a radio frequency transceiver configured to automatically transmit a data link clearance message over a data uplink; and a processor in operable communication with the sensor and the radio frequency transceiver, wherein the processor is configured to:

determine if a flight plan change improves a flight metric utilizing input from the sensor, determine if the flight plan change complies with an air traffic control policy, automatically formatting the data link clearance message to an air traffic control authority requesting a clearance when both the flight plan change improves a flight metric and complies with the air traffic control policy, otherwise repeating both determining steps and the automatically sending step.

18. The system of claim 17, wherein the air traffic control policy is an in trail procedure.

19. The system of claim 18, wherein the flight metric is one of an estimated time of arrival and a total cost of the flight.

20. The system of claim 19, wherein a flight crewman may review and abort the automatic sending of the data link message.

* * * * *